US005524753A

United States Patent [19]

Murphy

[11] Patent Number: 5,524,753

[45] Date of Patent: Jun. 11, 1996

[54] DEVICE FOR SECURING GOLF CLUBS

[76] Inventor: Thomas Murphy, 716 Princeton Blvd. #27, Lowell, Mass. 01851

[21] Appl. No.: 376,107

[22] Filed: Jan. 20, 1995

[51] Int. Cl.[6] ..... A63B 55/00

[52] U.S. Cl. ..... 206/315.6; 70/58; 70/62; 211/70.2

[58] Field of Search ..... 206/315.6, 315.3; 70/58, 61, 62, 230; 224/242, 916, 917; 211/70.2, 89

[56] References Cited

U.S. PATENT DOCUMENTS

| | | | |
|---|---|---|---|
| D. 336,603 | 6/1993 | Penaflor . | |
| 1,717,959 | 6/1929 | Cauffman | 206/315.6 |
| 3,139,132 | 6/1964 | Shiller | 206/315.6 |
| 3,664,616 | 5/1972 | Raskin | 70/58 X |
| 3,745,797 | 7/1973 | Pavek | 70/230 X |
| 4,522,299 | 6/1985 | Clark et al. | 206/315.6 X |
| 4,538,728 | 9/1985 | Lewis . | |
| 4,860,889 | 8/1989 | Lemieux et al. | 206/315.6 |
| 4,863,019 | 9/1989 | Lewis et al. . | |
| 5,004,100 | 4/1991 | Smith . | |
| 5,267,660 | 12/1993 | Kwon | 206/315.6 X |

*Primary Examiner*—Allan N. Shoap
*Assistant Examiner*—Christopher J. McDonald
*Attorney, Agent, or Firm*—Gary E. Lambert; Scott B. Garrison

[57] ABSTRACT

The device for securing golf clubs is intended for use in combination with a golf club bag having a mouth portion for receiving golf clubs and comprises a set of plates having slots which cooperate with each other to secure one or more golf club shafts between the slots. The device also contains a locking mechanism to secure the golf clubs to the bag.

7 Claims, 1 Drawing Sheet

DEVICE FOR SECURING GOLF CLUBS

BACKGROUND OF THE INVENTION

This invention is directed to a security device for use in conjunction with a golf club bag, for the purpose of securing golf clubs within the bag to prevent them from being tampered with or stolen. More particularly, the security device of this invention is a unique approach for securing golf clubs within a golf bag, which is easy to attach and accommodates any type of golf bag, is simple for the golfer to use and operate, and is very practical to manufacture and market.

Unfortunately, it has become common practice for golf clubs to be stolen from unattended golf bags at public and private golf courses. This problem has grown quite considerable over the last few years since the cost of golf clubs has increased dramatically. Various devices have been designed to prevent golf clubs from being stolen, but none have been widely or successfully marketed due to their various shortcomings.

One type of security device provides for a cover designed to fit over the mouth of a golf bag and completely enclose the golf clubs to prevent their removal. Examples of such devices are known from U.S. Pat. No. 1,570,510 (McQuirk); U.S. Pat. No. 1,908,998 (Mullins); U.S. Pat. No. 1,928,922 (Adams). These devices are not effective because they are made of materials, such as cloth or leather, that can easily be cut open to allow the golf clubs to be stolen.

Another type of security device provides for a plurality of holes through which individual golf club shafts may extend. These are shown in U.S. Pat. No. 1,770,060 (Burlow); and U.S. Pat. No. 1,717,959 (Cauffman). The former requires the inconvenience of turning the golf clubs upside down, which is the opposite way that most golf bags and golfer's store their clubs. The latter involves a rotating disc which may be rotated to clamp or unclamp the golf club shafts within the cover. The uniform size holes of this cover allow the finish of the shafts of some of the clubs to be marred or cut, while others may be loosely held, depending on the width of the shaft. Furthermore, it is impossible to secure a standard set of 14 golf clubs with this type of configuration because the inner holes of such a design will not adequately secure a golf club. In other words, the inner holes do not close sufficiently in relation to the outer holes in order to properly secure a golf club.

Another form of security device, shown in U.S. Pat. No. 4,538,728 (Lewis), comprises a cover for the top of a golf club bag made of a two piece pivoting shell which provides a single hole in its center for securing the shafts of a group of golf clubs. This design has numerous disadvantages: (a) When the two shells are closed, they cover the entire upper opening of the golf club bag, preventing the placement of any other items; (b) the mechanism is difficult to operate since the two half shells need to be carefully aligned; (c) the golf bag must be modified by adding retaining pins which protrude from the sides of the bag; (d) when not in use, the mechanism must be stored separately or hung by a chain from the side of the bag, which is not aesthetically pleasing.

Another type of security device, shown in U.S. Pat. No. 4,803,019 (Lewis), comprises a pair of elongated arms for gripping one or more golf club shafts and permanently attaches them to a golf bag. This design has numerous disadvantages: (a) The device permanently attaches to the golf bag, making it difficult to remove when playing a course where it may not be needed; (b) The golf bag must be modified with bolts or screws to properly attach the device; (c) One size does not fit all, consequently, it would be necessary to manufacture many sizes to fit the vast variety of golf bags available; (d) When not in use, the device's elongated arms make it difficult and awkward to remove golf clubs while playing the game; (e) This device is not aesthetically appealing for the user; (f) The device is difficult and awkward to use since the golf clubs must all be bunched in the center of the golf bag, and most bags do not allow for this.

Another form of security device, shown in U.S. Pat. No. 5,004,100 (Smith), comprises a device having three narrow slots with a U-shaped arm that pivots open and closed to secure golf clubs. This design has numerous disadvantages: (1) This device is difficult to use since each golf club must be laterally inserted in series in a through-cut slot; (2) When not in use, this large device may be difficult to store in standard golf bag pockets, or else, the device must be awkwardly hung from the side of the bag making it aesthetically unappealing; (3) Since this device secures the golf clubs in series, it makes it difficult and awkward if the user wants to remove a single club that is furthest away from the opening. In other words, one would have to remove several clubs in order to retrieve a single club and then re-insert all the clubs back in the device.

SUMMARY OF THE INVENTION

In accordance with an illustrated embodiment of the present invention, a device and method are provided for securing a plurality of golf clubs in a bag having an open mouth for insertion of clubs therein, each of the golf clubs having a head disposed at the end of a shaft which is narrower in a region near the head and wider in a region further from the head. The device generally comprises two stationary plates with a sliding plate contained within. Each of the plates contain slots, allowing golf clubs to be added or removed through them. The device is designed to fit over the top or mouth of a golf bag, and may also be designed to be manufactured as part of the golf bag itself. On one side of the device a locking mechanism is provided so that when the sliding plate is moved forward to secure the golf clubs within the slots, the position of the sliding plate can be locked in place to prevent the plate from opening so that the clubs cannot be removed.

The greater dimensions of the tapered golf club handles prevent removal of any one golf club while the plates are closed together over the top of the golf bag. An area of resilient material is provided around the inner periphery of the slots in order to hold the golf clubs firmly together and to prevent injuring the golf clubs by contact of the slot portion of the security device. Keepers are provided along the edge of the security device in order to secure this device to a golf club bag.

Consequently, the device may be locked either when in an open or a closed position and furthermore, may be locked to another object, such as a pole, when one desires the device and the accompanying golf bag to be locked.

Broadly, it is the object of this invention to provide a marketable and effective solution for securing golf clubs in a golf bag in which the disadvantages and drawbacks mentioned above are avoided or minimized. The following are objects and advantages of this invention:

(a) to provide a device that can be easily attached and removed from a golf club bag so that the golf bag does not have to be modified with pins, bolts, screws, etc.;

(b) to provide a device that is inexpensive and simple to manufacture so that it can be sold at a reasonable price and successfully marketed;

(c) to provide a device that is easy and simple for the user to operate;

(d) to provide a device that is aesthetically appealing to the user in which the golf clubs can be inserted and removed by traditional means;

(e) to provide a device that can effectively secure one or as many golf clubs that a golfer would carry in their bag;

(f) to provide a device that would not require a special locking device, but that utilizes a traditional cable lock or padlock;

(g) to provide a device which enables the user to secure the golf clubs and golf bag to another object such as a tree, pole, or golf cart;

(h) to provide a device that can easily accommodate all the different sizes and shapes of golf bags;

(i) to provide a device that can remain on a golf bag without adversely effecting its function or looks; and (j) to provide a device which can be built into the internal structure of a golf bag, making it an important value-added benefit.

These and other objects and advantages of my invention will become apparent from a consideration of the drawings and ensuing description.

DETAILED DESCRIPTION OF THE PREFERRED EMBODIMENT

Figure 1:
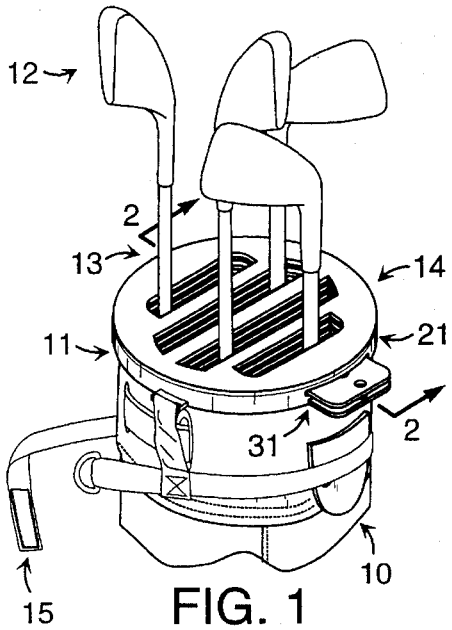
FIG. 1 is front perspective view of the device for securing golf clubs, mounted on a golf bag.

Referring now to the details of the drawings, FIG. 1 is a perspective view of a generally tubular golf club bag 10 with an open mouth 11. A set of golf clubs 12 is disposed in the bag with their shafts 13 extending down through the open mouth. A security device 14 is shown, in accordance with the present invention, in an open position with golf clubs 12 extending therethrough. Attaching device 15 allows security device 14 to be attached to bag 10.

Figure 2:
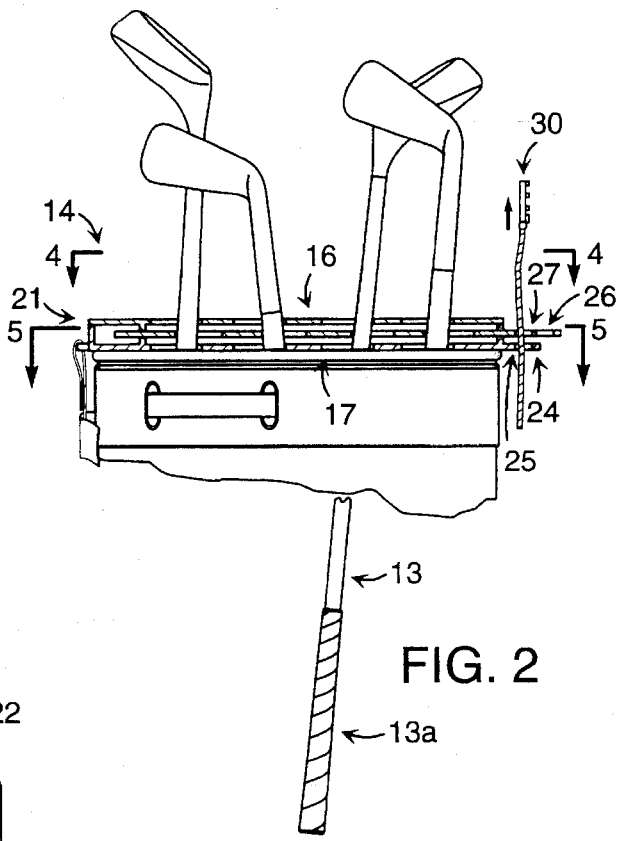
FIG. 2 is a sectional view.
Figure 3:
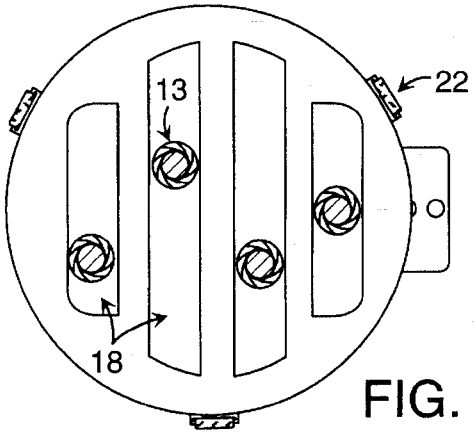
FIG. 3 is top plan view of the main body of the security device and the mouth of a golf club bag adapted for combination with the security device of the invention showing the device in an open position.
Figure 4:
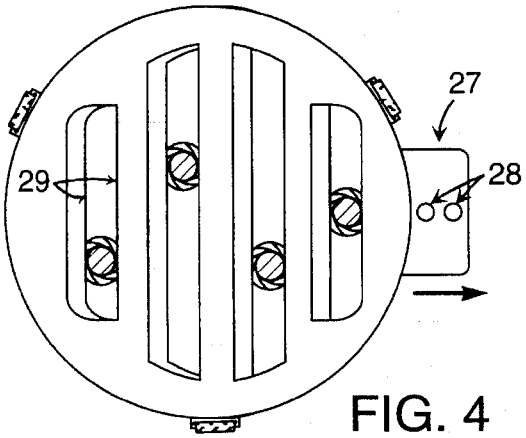
FIG. 4 is a top plan view of the main body of the security device showing the golf clubs securely fastened within the slots of that device when that device is in a closed position.
Figure 5:
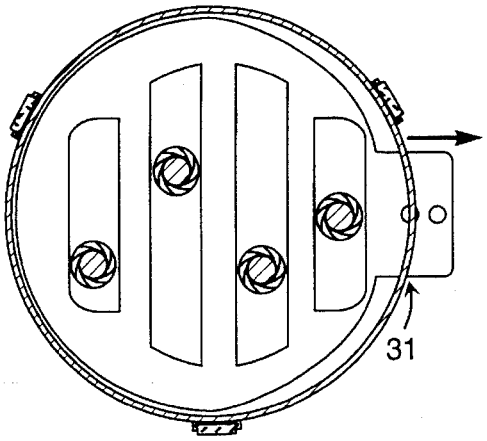
FIG. 5 is a top plan break away view of the main body of the security device showing the top portion of that device removed and showing the middle sliding portion of that device with the golf clubs contained therein.

FIG. 2 shows a cross-sectional view of security device 14, which is comprised of top plate 16 which is rigidly connected to bottom plate 17 by collar 21. Collar 21 contains keepers 22, which allow for attaching device 15 to secure security device 14 to bag 10. As shown in FIGS. 3, 4 and 5, plates 16 and 17 are provided with a series of slots 18 through which the shafts 13 of the different types of golf clubs used by the player are adapted to extend, the slots 18 being of a size slightly larger than the diameters of the tapered handle portions 13*a* of the clubs to permit easy passage of the latter through said slots. Plates 16 and 17 are essentially identical, with the exception that bottom plate 17 contains locking lip 24 wherein which is defined a hole 25.

FIG. 2 shows sliding plate 26 movably disposed between top plate 16 and bottom plate 17. Slide plate 26 is likewise provided with a series of slots 18 in the same manner and fashion as plates 16 and 17. Like bottom plate 17, sliding plate 26 has a locking lip 27, however, lip 27 contains two holes 28.

The normal open position of security device 14 when the player is using the bag is shown in FIGS. 1 and 3 and the locking or club retaining position is shown in FIGS. 2 and 4. In the last named figures, the edges 29 of slots 18 of sliding plate 26 cooperate with the edges 29 of slots 18 of top plate 16 and bottom plate 17 to steady the clubs, whereby they are prevented from rattling and by reason of the taper of the shafts 13, said edges 29 prevent withdrawal of the clubs from the bag. Security device 14 is placed in a locked or club retained position by movement of locking lip 27 of sliding plate 26 through opening 31 in collar 21 in the direction of the arrow shown in FIGS. 4 and 5. Device 14 is placed in the open position by movement of sliding plate 26 in the opposite direction.

As described, locking lip 24 of bottom plate 17 contains hole 25, while locking lip 27 of sliding plate 26 contains two holes 28. When security device 14 is in the open position, hole 25 of locking lip 24 is in direct alignment with one of holes 28 of locking lip 27, thereby allowing for the use of a locking device 30, as shown in FIG. 2. Likewise, when device 14 is in the locked position, hole 25 is in direct alignment with the other hole 28 of locking lip 27. In either case, the use of locking device 30, in this case a cable lock, prevents movement of sliding plate 26, thereby insuring that device 14 will remain in a closed or locked position for as long as the player desires.

I claim:

1. A device for securing golf clubs, comprising:

a top, bottom, and slide plate, said plates having a plurality of slots defined by an edge, said bottom and slide plates each further having locking means comprising at least one hole;

a collar having an inside and outside wall with an opening extending through said walls, said inside wall permitting horizontal linear movement of said slide plate and said locking means of said slide plate is movably disposed within said opening and said top and bottom plates are rigidly attached to the top and bottom of said collar respectively.

2. The device of claim 1 wherein said locking means of said slide plate has a first and second hole and the movement in one direction of said slide plate causes the first hole to be in alignment with the hole of said bottom plate while movement in the opposite direction causes the second hole to be in alignment with the hole of said bottom plate.

3. The device of claim 2 further comprising securing means, disposed between either the first or second hole of said locking means of said slide plate and the hole of said locking means of said bottom plate to prevent the movement of said slide plate.

4. The device of claim 3 further comprising a plurality of golf clubs disposed within the slots of said device such that when the slots of said plates are aligned the clubs are easily moved within said slots and which, when said sliding plate is moved toward said clubs, the edges of said slots prevent the removal of said clubs.

5. The device of claim 4 further comprising attaching means, fastened to said device, which allows for the attachment of said device to a golf bag.

6. An improved golf-club bag, wherein the improvement comprises:

three stacked plates, each having slots, incorporated into the top of said bag such that the centermost plate moves in cooperation with the outermost plates to prevent removal of golf clubs from the bag through engagement with opposite portions of said clubs, said plates further having locking means to lock said clubs within said bag.

7. A device for securing golf clubs, comprising: a plurality of plates, each having a plurality of slots, and at least one plate having locking means, such that one of said plates moves in horizontal linear cooperation with at least one of the other said plates to prevent removal of golf clubs from a golf bag when said device is attached to the top of said bag and said clubs are disposed within said slots, thereby allowing said clubs to be locked in said bag.

* * * * *